US009809943B2

(12) United States Patent
Bonnemaison

(10) Patent No.: US 9,809,943 B2
(45) Date of Patent: Nov. 7, 2017

(54) METHOD FOR INSTALLING AN ELONGATE ELEMENT IN A STRETCH OF WATER, AND ASSOCIATED DEVICE AND INSTALLATION

(71) Applicant: TECHNIP FRANCE, Courbevoie (FR)

(72) Inventor: Didier Bonnemaison, Collegien (FR)

(73) Assignee: TECHNIP FRANCE (FR)

( * ) Notice: Subject to any disclaimer, the term of this patent is extended or adjusted under 35 U.S.C. 154(b) by 0 days.

(21) Appl. No.: 14/770,587

(22) PCT Filed: Feb. 19, 2014

(86) PCT No.: PCT/EP2014/053189

§ 371 (c)(1),
(2) Date: Aug. 26, 2015

(87) PCT Pub. No.: WO2014/131662

PCT Pub. Date: Sep. 4, 2014

(65) Prior Publication Data

US 2016/0002873 A1 Jan. 7, 2016

(30) Foreign Application Priority Data

Feb. 27, 2013 (FR) ..... 13 51715

(51) Int. Cl.
*B63B 35/44* (2006.01)
*E02B 17/02* (2006.01)
(Continued)

(52) U.S. Cl.
CPC ..... *E02B 17/02* (2013.01); *B63B 27/10* (2013.01); *B63B 35/003* (2013.01); *B63B 35/44* (2013.01);
(Continued)

(58) Field of Classification Search
USPC ..... 405/158, 169, 170
See application file for complete search history.

(56) References Cited

U.S. PATENT DOCUMENTS 5,433,273 A * 7/1995 Blandford ..... E21B 43/017 166/344
2003/0123936 A1* 7/2003 Karal ..... B63B 21/502 405/223.1
(Continued)

FOREIGN PATENT DOCUMENTS

FR WO 2012120381 A2 * 9/2012 ..... F16L 1/19
WO WO 2010/138622 A2 12/2010

OTHER PUBLICATIONS

International Search Report dated Apr. 24, 2014 issued in corresponding International patent application No. PCT/EP2014/053189.

*Primary Examiner* — Kyle Armstrong
(74) *Attorney, Agent, or Firm* — Ostrolenk Faber LLP

(57) ABSTRACT

A method for installation of an elongate element in a stretch of water, the method including reversible fastening of a connecting member (34) at a first end (16) of the elongate element (10); arranging the elongate element (10) in a substantially horizontal configuration; reversibly engaging the connecting member (34) in a retaining member (36); pivoting the elongate element (10) about a substantially horizontal axis to move the elongate element (10) into a substantially vertical configuration, while the connecting member (34) remains engaged in the retaining member (36); joint lowering of the retaining member (36), the connecting member (34) and the elongate element (10) in the stretch of water (12) with the help of a lowering line (152); detaching the connecting member (34) of the first end (16) of the elongate element (10), and joint raising of the retaining member (36) and the connecting member (34).

19 Claims, 7 Drawing Sheets

(51) Int. Cl.

| | |
|---|---|
| ***E02D 27/42*** | (2006.01) |
| ***B63B 27/10*** | (2006.01) |
| ***B63B 35/00*** | (2006.01) |
| *E02B 17/00* | (2006.01) |

(52) U.S. Cl.
CPC ..... *E02D 27/42* (2013.01); *E02B 2017/0039* (2013.01); *E02B 2017/0047* (2013.01); *E02B 2017/0056* (2013.01); *E02B 2017/0095* (2013.01)

(56) References Cited

U.S. PATENT DOCUMENTS

2011/0258829 A1* 10/2011 Vanderbeke ..... E02B 17/027 29/428
2011/0262229 A1* 10/2011 Tame ..... F16L 1/166 405/166

* cited by examiner

METHOD FOR INSTALLING AN ELONGATE ELEMENT IN A STRETCH OF WATER, AND ASSOCIATED DEVICE AND INSTALLATION

CROSS REFERENCE TO RELATED APPLICATIONS

The present application is a 35 U.S.C. §371 National Phase conversion of PCT/EP2014/053189, filed Feb. 19, 2014, which claims benefit of French Application No. 13 51715, filed Feb. 27, 2013, the disclosure of which is incorporated herein by reference. The PCT International Application was published in the French language.

TECHNICAL FIELD OF THE INVENTION

The present invention relates to a method for positioning an elongate element in a stretch of water.

The stretch of water is, for example, a sea, an ocean, or lake.

BACKGROUND OF THE INVENTION

Such a method is intended in particular to install the elongate element in a large stretch of water, such as anchor piles for a fluid-operated device in a stretch of water, or other components of such an installation.

The anchor piles are inserted at the bottom of the stretch of water. They are intended, for example, to retain offshore structures, such as semi-submersible platforms, of the floating-type column type ("SPAR"), or the cable-tensioned type ("Tension Leg Platform" or "TLP") or floating installations of the FPSO type. Alternatively, the offshore structure is a fixed platform such as a "jack up platform" or any anchor element on the seabed.

To ensure retention of an offshore structure, each elongate element has a substantial length in a horizontal position and therefore a significant height when it is in a vertical position. The horizontal length is, for example, longer than 10 m and in particular in the order of 50 m to 150 m.

The elongate element has, for example, a diameter greater than 1 m, and especially greater than 5 m.

When the elongate element is made of base metal, it therefore has a significant weight of several hundred tonnes.

Therefore, the elongate element cannot simply be manoeuvred using a crane, since the crane would have to have too great a height and lifting capacity to be mounted on a surface laying facility, such as a laying vessel.

In a known installation method, each elongate element is arranged on a barge in a horizontal position, and is brought to the place of installation by the barge.

At the installation location, the barge is arranged alongside a laying vessel. Then, connecting members are mounted on the elongate element, at a distance from the ends. Each connecting member comprises a sleeve arranged around the elongate element and an axle inserted through the elongate element by means of holes made in the wall of this element.

The sleeve and the elongate element are rotatably mounted on the axle. When the elongate element is to be immersed, a first connecting member is rotatably fixed to a support trellis projecting laterally with respect to the laying vessel.

Then, the other connecting member is released. The elongate element then pivots around the axle of the first connecting member under the effect of its own weight in order to adopt a vertical configuration.

Then, a lowering line is attached to the upper end of the elongate element. The connecting member fixed on the trellis is then released to lower the elongate element in the stretch of water by unwinding the lowering line.

Such an approach makes it possible to install elongate elements of a substantial size. However, it is not entirely satisfactory.

In fact, the installation operations to be implemented for the method are relatively complex, since it is necessary to make holes in the wall of the elongate element, and then mount an axle through the holes.

It is also difficult to remove the connecting member once the elongate element is at the bottom of the water.

Moreover, making holes through the elongate element may, in some cases, reduce its mechanical strength and therefore weaken the elongate element.

SUMMARY OF THE INVENTION

An object of the invention is to develop a method of installing an elongate element of significant size and/or weight, which is simple to implement and which does not affect the mechanical properties of the elongate element.

To this end, the invention relates to a method of the aforementioned type, characterised in that it comprises the following steps:

- reversible attachment of a connecting member to a first end of the elongate element;
- provision of the elongate element in a substantially horizontal configuration along a surface facility;
- reversible engagement of the connecting member in a retaining member protruding with respect to the surface facility;
- pivoting the elongate element about a substantially horizontal axis to place the elongate element in a substantially vertical configuration, wherein the connecting member remains engaged in the retaining member;
- joint lowering of the retaining member, the connecting member and the elongate element in the stretch of water with the aid of a lowering line carried by the surface facility;
- detachment of the connecting member from the first end of the elongate element, and joint raising of the retaining member and the connecting member.

The method according to the invention may include one or more of the following characteristics, in isolation or in any technically possible combination:

- the reversible engagement of the connecting member in the retaining member comprises the suspension of the connecting member and the first end of the elongate element under the retaining member;
- the reversible engagement of the connecting member in the retaining member involves the reversible locking of the connecting member in the retaining member;
- the method involves engaging a first movement line on the connecting member and the engagement of a second movement line at a second end of the elongate element, wherein the elongate element is suspended between the first movement line and the second movement line, wherein the arrangement of the elongate element in its substantially horizontal configuration along the surface facility is performed by manoeuvring of the first movement line and/or the second line movement;
- the reversible attachment of the connecting member comprises the insertion of a connecting head of the connecting member in an end housing at the first end of the elongate element and the reversible locking of the connecting head at the first end of the elongate element, able to operate without drilling the elongate element during the insertion and locking;

the connecting member comprises an articulation element, wherein the connecting head is pivotally connected to a first region of the articulation element, and wherein the method comprises engaging a first movement line of the elongate element on a second region of the articulation element, and the reversible engagement of a third region of the articulation member on the retaining member;

the retaining member is wedged in translation between two wedging ribs of a frame carried by the surface facility.

The invention also relates to a positioning device for an elongate element in a stretch of water, characterised in that it comprises:

its own connecting member to be reversibly attached to a first end of the elongate element;

an elongate element movement assembly to arrange the elongate element in a substantially horizontal configuration along a surface facility;

a retaining member that is intended to project with respect to the surface facility, wherein the connecting member is reversibly movable between a starting position in which it is disengaged from the retaining member, and a lowered position in which it is engaged in a reversible manner in the retaining member;

a mechanism to pivot the elongate element about a substantially horizontal axis in order to move the elongate element into a substantially vertical configuration, wherein the connecting member remains engaged in the retaining member;

a joint lowering assembly of the retaining member, the connecting member and the elongate member in a stretch of water having a lowering line intended to be carried by the surface facility.

The arrangement according to the invention may include one or more of the following characteristics in isolation or in any technically possible combination:

in the lowering position, the connecting member is suspended from the retaining member;

the connecting member comprises a reversible locking assembly in the retaining member;

the movement assembly comprises a first movement line intended to be engaged on the connecting member and a second movement line to be engaged at a second end of the elongate element in order to suspend the elongate element between the first movement line and the second movement line, wherein the movement assembly comprises a manoeuvring device of the first movement line and/or the second movement line;

the connecting member comprises an insertion head intended to be inserted in a housing formed at the first end of the elongate element without drilling, and a reversible mechanism to lock the insertion head in the housing without drilling;

the connecting member comprises an articulation element, wherein the connecting head is pivotally connected to a first region of the articulation element, and the articulation element has a second region intended to be engaged by a first movement line of the movement assembly, and a third region of the articulation element is intended to engage on the retaining member;

the retaining member comprises an upper part intended to be carried by the lowering line, and a lower engagement hook of the connecting member, wherein the upper part and the lower hook are rotatably movable with respect to one another along at least one axis, preferably along three axes;

the arrangement comprises a frame intended to be mounted to project with respect to the surface facility, wherein the retaining member is suspended in the frame, preferably by means of the lowering line;

the frame comprises at least two parallel ribs for wedging in translation the retaining member;

the retaining member has wedging plates to work with the ribs.

The invention also relates to the installation of an elongate element in a stretch of water, characterised in that it comprises:

a surface facility, preferably floating on the stretch of water;

a device as defined above, carried by the surface facility.

BRIEF DESCRIPTION OF THE DRAWINGS

The invention will be better understood on reading the description below, but this is given solely by way of example and with reference to the accompanying drawings, in which.

DESCRIPTION OF PREFERRED EMBODIMENTS

Figure 4:
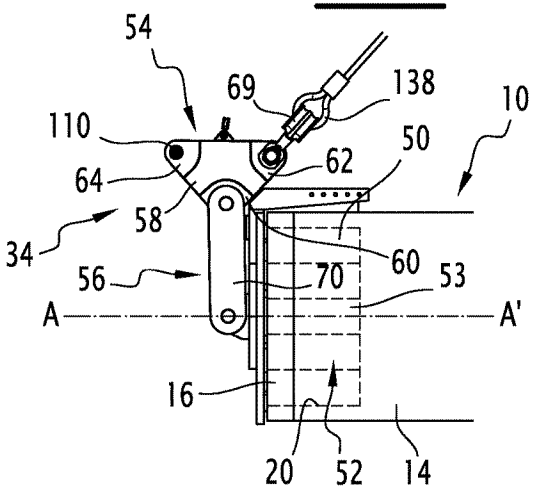
FIG. 4 is an enlarged end view of an elongate element on which is fixed a connecting member of the device of FIG. 1.
Figure 8:
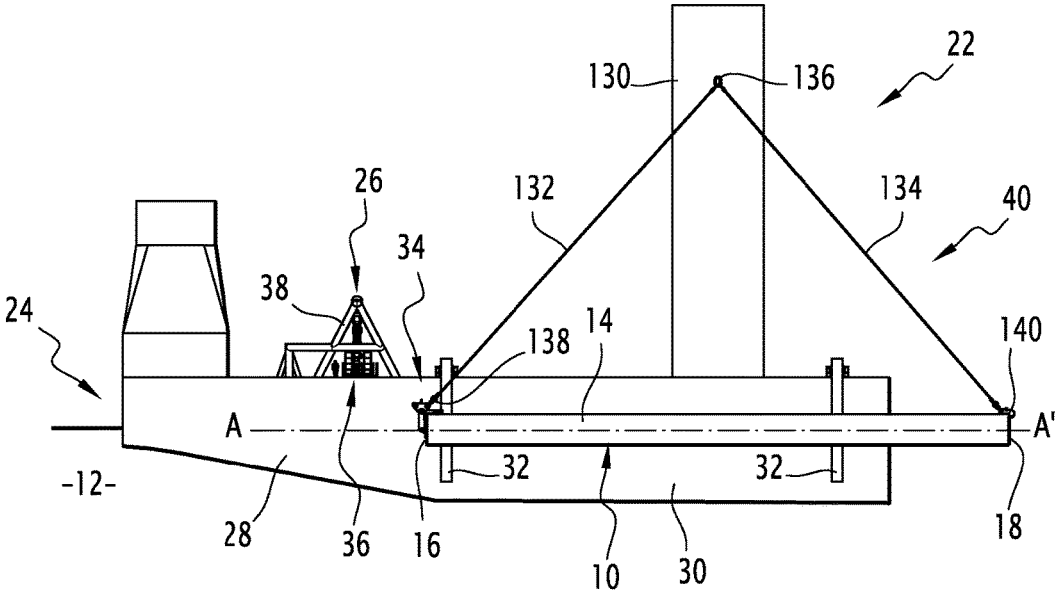
FIGS. 8 to 15 are views similar to FIG. 1 of successive steps of the method according to the invention during the installation of an elongate element.

A first method according to the invention is intended for the introduction of an elongate element 10 in a stretch of water 12 as shown in FIG. 4 and in FIG. 8. The elongate element 10 forms a component of, for example, an offshore structure at least partially submerged in a stretch of water 12.

The structure (not shown) is advantageously designed for the movement of fluid through a stretch of water 12, in particular for collecting fluid collected at the bottom of the stretch of water 12 and bringing it to the surface.

The fluid collected preferably contains a hydrocarbon. It is for example formed by natural gas or oil.

The stretch of water 12 is a sea, an ocean, or a lake. The depth of the stretch of water 12 to the right of the installation 10 is, for example, greater than 20 m, in particular between 20 m and at least 3000 m.

The structure is, for example, a platform attached to the bottom of the stretch of water 12 or preferably floating on the stretch of water 12. This particular platform is especially of the semi-submersible type, the floating column type ("SPAR"), or tensioned cable type ("Tension Leg Platform" or "TLP"). Alternatively, the structure is a floating installation such as an FPSO. In another variant, the structure is a fixed platform such as a "jack up platform" or an anchor element on the seabed.

The elongate element 10 forms, for example, an anchor element of the structure at the bottom of the stretch of water, such as an anchor pile.

The elongate element 10 has a substantial length in a horizontal configuration, for example greater than 10 m and in particular in the order of 50 m to 150 m long. The elongate element 10 has for example a diameter greater than 1 m, and especially greater than 5 m.

The elongate element 10 is made of base metal and, therefore, has a significant weight of more than 100 tonnes.

As illustrated in FIG. 4, the elongate element 10 includes a tubular wall 14, made of metal and extending along an axis AA' between a first end 16, shown in FIG. 4, and a second end 18, shown in FIG. 8.

As discussed below, the elongate element 10 opens axially at the first end 16 and delimits a housing 20 to receive a connecting member.

The elongate element 10 is arranged in the stretch of water 12 according to the method of the invention, using an installation 22 of the invention as illustrated in FIGS. 1 to 15.

Figure 14:
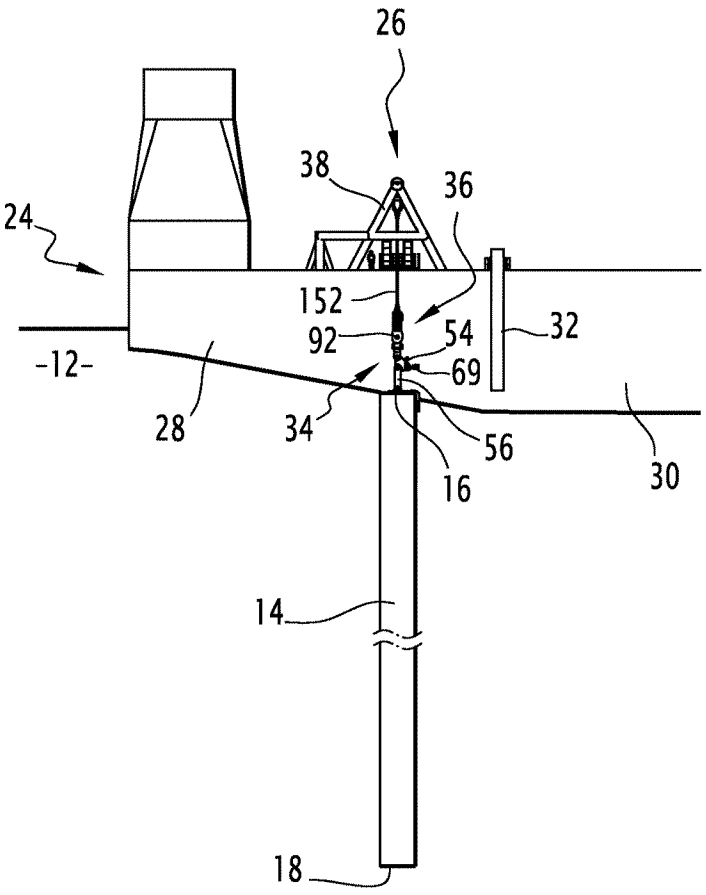
Figure 13:
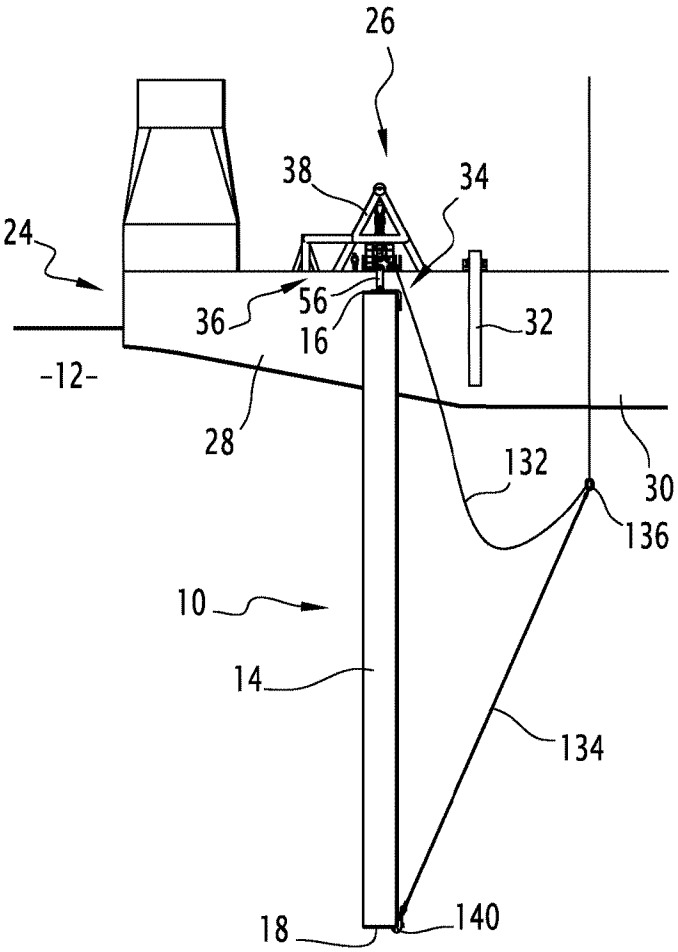

During this installation, the elongate element 10 moves from a horizontal transport configuration, shown in FIG. 8, to a vertical lowering configuration, shown in FIGS. 13 and 14, in order to be lowered to the bottom of the stretch of water 12.

As shown in FIGS. 1 to 7, the installation 22 includes a surface facility 24, and installation device 26, carried by the surface facility 24.

The surface facility 24 floats on the stretch of water 12. In this example, it is in the form of an installation vessel 28. Alternatively (not shown), the surface facility 24 may be a barge or platform as described above.

In this example, the surface facility 24 extends along a longitudinal axis BB'. It comprises a lateral surface shell 30 provided with protection and support guard rails 32 longitudinally spaced along the axis B-B'.

Each guard rail 32 is, for example, formed from an elastomer strand, or a wooden beam.

The guard rails 32 are intended to protect the side surface of the shell 30 when the elongate element 10 is placed along this surface 30. The elongate element 10 is designed to bear against the guard rails 32 to limit the lateral movement of the elongate element 10 when it is manipulated.

Figure 3:
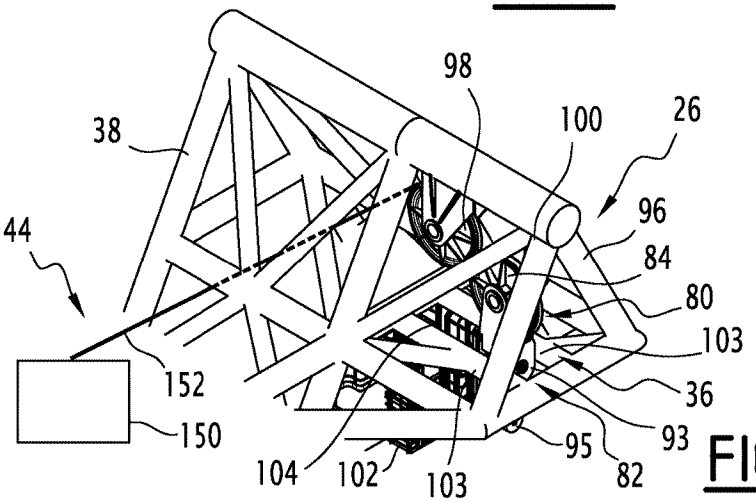
FIG. 3 is a partial perspective view of a support frame and a retaining member of the device of FIG. 1.
Figure 7:
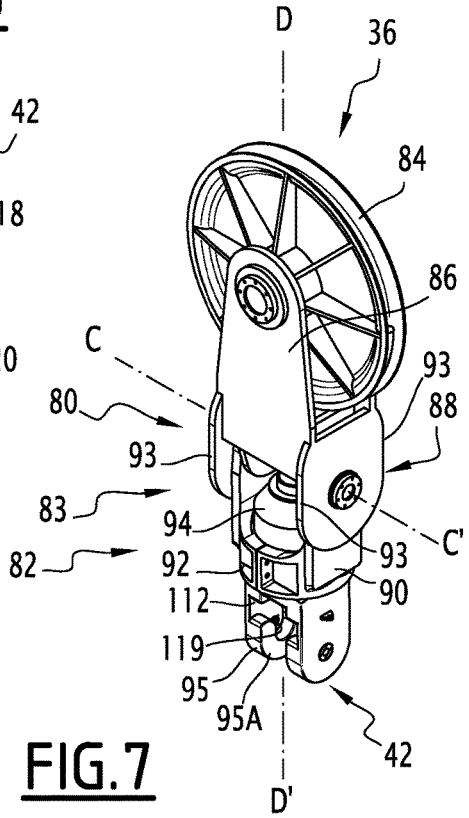
FIG. 7 is a perspective view of a retaining member of the device of FIG. 1.

The installation device 26 according to the invention includes a connecting member 34 designed to be reversibly attached to the first end 16 of the elongate element 10, a retaining member 36 to retain the connecting member 34, shown in particular in FIGS. 3 and 7, and a support frame 38 for the retaining member 36 fixed to the surface facility 24 and projecting with respect to the stretch of water 12.

The device 26 further comprises a movement assembly 40 on the surface of the elongate element 10 along the surface facility 24, shown especially in FIG. 8, a mechanism 42 to pivot and lock the elongate element 10 in position between the retaining member 36 and the connecting member 34 in order to pivot the elongate element 10 from a horizontal configuration to a vertical configuration (see FIG. 10), and an assembly 44 for the vertical lowering of the elongate element 10 in the stretch of water 12, shown in FIG. 3.

According to the invention, the connecting member 34 is fixed in a fully reversible manner on the first end 16 of the elongate element 10, without the need to drill the tubular wall 14 of the elongate element 10, or to weaken it mechanically.

Figure 15:
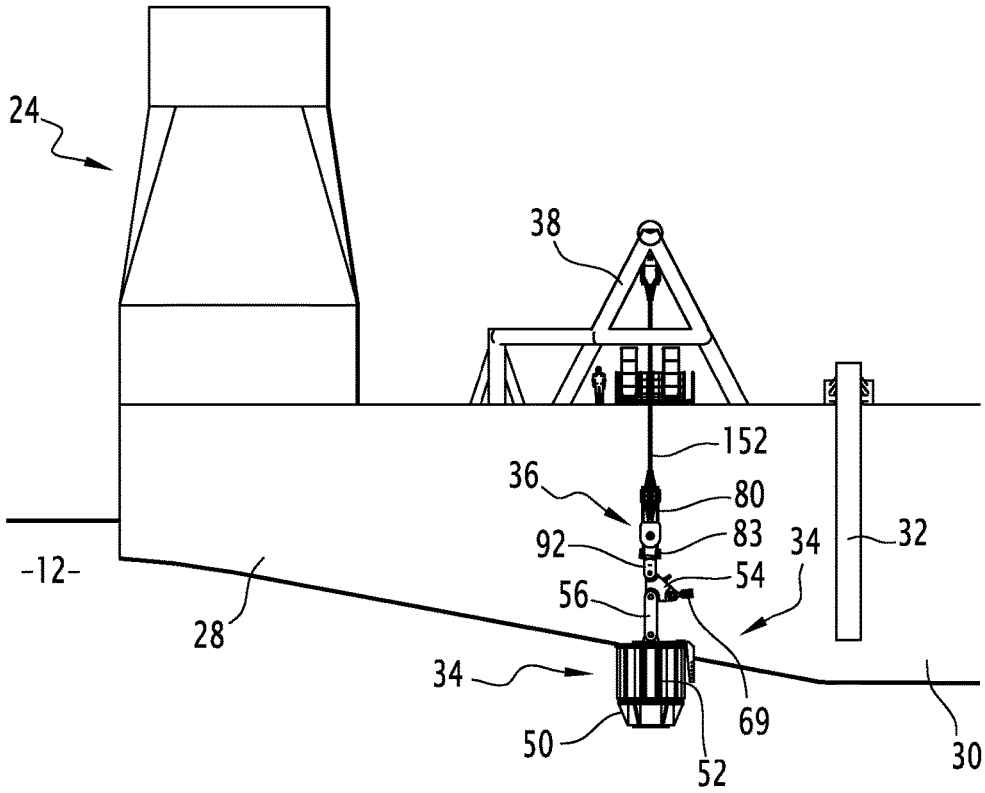

Referring to FIGS. 4 and 15, the connecting member 34 has an insertion head 50, that is reversibly inserted into the receiving housing 20, and a releasable locking mechanism 52 of the insertion head 50 at the end 16 of the elongate element 10.

The connecting member 34 further comprises an articulation and connecting element 54 designed to be connected to the retaining member 36 and the movement assembly 40, and a connection element 56 between the articulation element 54 and the insertion head 50.

The locking mechanism 52 advantageously includes radially deployable jaws 53 extending from the insertion head 50, to abut against the inner surface of the elongate element 10.

The jaws 53 are designed to reversibly immobilise the head 50 at the end of the elongate element 10.

Figure 5:
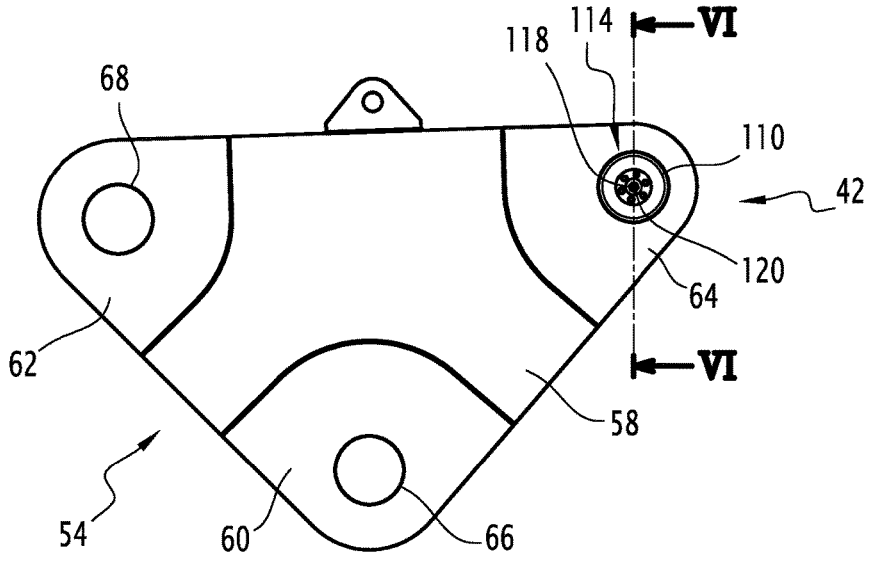
FIG. 5 is a front view of an articulation element of the connecting member of FIG. 4.

As shown in FIGS. 4 and 5, the articulation element 54 is formed by a plate 58 which has a preferably inverted triangular shape.

The articulation element 54 has a first lower region 60 connecting with the head 50, a second upper region 62 connecting with the movement assembly 40 and a third region 64 connecting with the upper retaining member 36 receiving a part of the pivot mechanism 42.

The first region 60 defines an articulation hole 66 of the connecting member 56. The second region 62 defines a hole 68 for fixing a body 69 for the fast connection/disconnection of a line of the movement assembly 40, as shown in FIG. 4.

The connecting member 56 comprises a rod 70 articulated at an upper end on the first region 60 of the articulation element 54 and articulated at a lower end of the head 50.

As will be seen below, the connecting member 34 is designed to engage in a reversible manner in the retaining member 36 via the pivot mechanism 42 in order to be suspended in the retaining member 36, and permit pivoting of the elongate element 10 between the horizontal configuration and the vertical configuration.

In the example shown in FIG. 7, the retaining member 36 comprises an upper part 80 connecting with the lowering assembly 44, a lower part 82 engaging and retaining the connecting member 34, and an intermediate connecting member 83.

In this example, the upper part 80 includes an upper connecting pulley 84, a top yoke 86 supporting the pulley 84 and a lower yoke 88 connected to the intermediate member 83.

The intermediate member 83 includes an upper yoke 90 articulated on the lower yoke 88 of the upper part 80 about a horizontal axis CC' that is preferably perpendicular to the axis of the upper pulley 84. The intermediate member 83 further comprises a seat 92 to retain the lower part 82.

In the embodiment of FIG. 7, the top yoke 90 of the intermediate member 83 is received in the lower yoke 88 of the upper part 80. The top yoke 90 has a width, measured parallel to the axis C C', that is less than the width of the lower yoke 88.

The upper part 80 defines wedging plates 93 for wedging in translation the upper part 80 along the longitudinal axis B-B'. The plates 93 extend on either side of the axis C-C', and are substantially perpendicular to this axis.

The wedging plates 93 are preferably defined on the lateral edges of the lugs of the lower yoke 88 on both sides of the axis C-C'.

The axis C-C' is located substantially halfway between the opposing plates 93.

As will be seen below, the plates 93 are intended to work with the ribs present on the supporting frame 38 in order to ensure wedging during translation.

The lower part 82 advantageously has a connecting projection 94 rotatably received in the seat 92 about an axis DD' that is perpendicular to the vertical axis C-C'. It comprises a lower receiving hook 95 of the connecting member 34.

Thus the lower part 82 is rotatably mounted about at least one axis, preferably about at least three axes with respect to the upper part 80 in order to accept the relative movements between the connecting member 34 and the retaining member 36 during the installation of the connecting member 34 in the retaining member 36.

The upper yoke 86, the lower yoke 88, the intermediate member 83, and the assembly of the projection 94 and the seat 92, thus form a universal joint.

The hook 95 carries a part of the pivot mechanism 42. It defines a lower slot 95A intended to receive the third region 64 of the connecting member 34.

Figure 2:
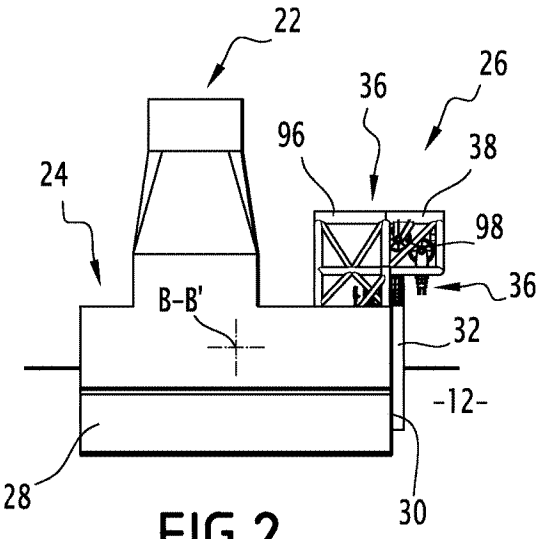
FIG. 2 is a rear view of the device of FIG. 1.
Figure 1:
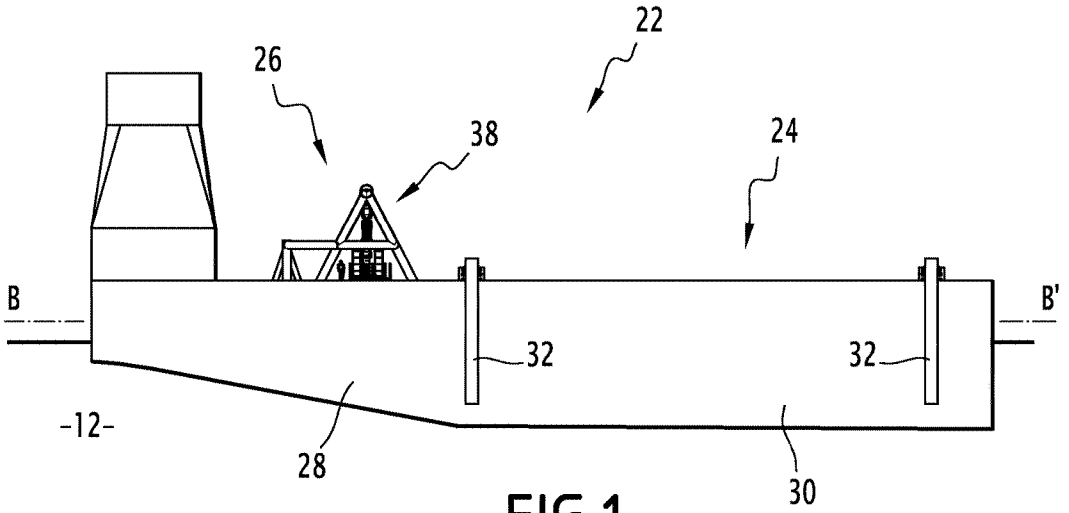
FIG. 1 is a side view of the surface facility for a device for the implementation of a first method according to the invention.

As shown in FIG. 2 and FIG. 3, the frame 38 projects laterally to the axis B-B' beyond the outer edge of the shell surface 30, with respect to the stretch of water 12.

In this example, the frame 38 has a open trellis 96, a retaining pulley 98 carried by the open trellis 96, and an attachment link 100 to fix one end of the lowering assembly 44. It advantageously comprises a platform 102 designed to accept an operator of the retaining member 36.

As indicated above, the frame 38 further comprises two parallel lateral flanges 103, intended for wedging in translation along the axis B-B' the upper part 80 of the retaining member 36.

The retaining pulley 98 projects downwards from a beam of the open trellis 96. It is located with respect to the stretch of water 12.

The retaining member 36 is suspended between the retaining pulley 98 and the attachment link 100.

The lateral flanges 103 protrude perpendicularly to the axis B-B'. They define between them a lateral receiving passage 104, through which the retaining member 36 is engaged.

The lateral passage 104 is located below the retaining pulley 98. It extends laterally to the axis B-B'.

When the retaining member 36 is suspended, the plates 93 located on either side of the axis CC' on the upper part 80 are received in the lateral passage 104. They respectively abut forwards and rearwards against a lateral flange 103.

The upper part 80 of the retaining member 36 is thus wedged in translation along the axis B-B', with a degree of freedom in translation perpendicular to the axis B-B'.

Figure 6:
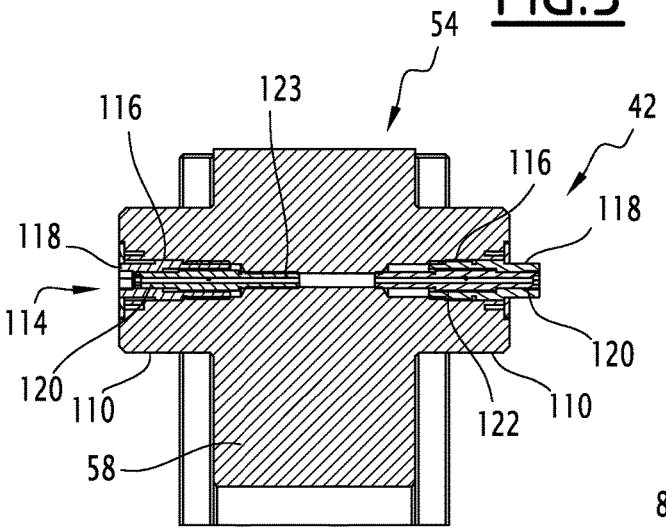
FIG. 6 is a view taken in section along the plane VI-VI of FIG. 5.

Referring to FIGS. 5, 6 and 7, the pivot mechanism 42 comprises a pair of pivots 110, secured to one of the connecting members 34 and the retaining member 36. It has a recess 112 for each pivot 110 to receive the pivot 110, formed in the other connecting member 34 and the retaining member 36.

The pivot mechanism 42 further includes a locking assembly 114 to lock each pivot 110 in an associated recess 112.

In the example shown in the figures, the pivot mechanism 42 comprises a pair of pivots 110 secured to the connecting member 34, the retaining member 36 defining the recesses 112 receiving each pivot 110.

As shown in FIGS. 5 and 6, the pivots 110 protrude laterally with respect to the third region 64 of the articulation element 54, on either side of this element 54.

Each pivot 110 internally defines a receiving recess 116 to receive the locking assembly 114.

As shown in FIG. 7, the recesses 112 are delimited in two lateral walls opposite the hook 95 on either side of the slot 95A. Each recess 112 is open at a first axial end to allow insertion of a pivot 110 in the recess 112, and is closed at a second axial end to block the pivot 110 in the recess 112.

Each recess 112 also opens laterally on a first side in the slot 95A and is closed laterally on a second side opposite to the slot 95A.

A locking hole 119, formed in the lateral wall of the hook 95, opens laterally into each recess 112.

As shown in FIG. 6, the locking assembly 114 includes an external locking pin 118 that is deployed in order to be received in a corresponding locking hole 119, and an internal pin 120 to immobilise the external pin 118.

Advantageously, the external pin 118 is screwed into the housing 116. It defines a passage 122 receiving the internal pin 120.

Referring to the left part of FIG. 6, when the internal pin 120 is retracted into the passage 122, the external pin 118 can be deployed by screwing it out of the housing 116 in order to protrude beyond the pivot 110. Referring to the right part of FIG. 6, once the external pin 118 is deployed and received in the locking hole 119, the pivot 110 is fixed in an axial position in the recess 112.

The internal pin 120 is then deployed in the passage 122 to prevent the unscrewing of the locking pin 118.

To this end, an inner part of the internal pin 120 that is received in a threaded extension 123 of the housing 116, is unscrewed.

The locking assembly 114, including the pins 118, 120 has the function of preventing disengagement of the connecting member 34 from the retaining member 36, particularly during the joint lowering of the elongate element 10, the retaining member 36, and the connecting member 34.

The locking assembly 114, however, does not take up any of the load from the retaining member 36 as the load is taken up by the pivots 110.

As will be seen below, the connecting member 34 is reversibly moveable with respect to the retaining member 36, between a starting position when disengaged from the retaining member 36 and a lowered position when it is engaged with the retaining member 36.

When the connecting member 34 is engaged with the retaining member 36, the pivots 110 are received in the recesses 112.

The connecting member 34 is then able to rotate about a horizontal axis with respect to the retaining member 36.

As the elongate element 10 is connected to the articulation element 54 of the connecting member 34 by an articulated connecting element 56, there is at least a degree of rotational freedom between the elongate element 10, the connecting member 34, and the retaining member 36. There is also a mobility along the axis C-C'.

This facilitates the engagement of the connecting member 34 with the retaining member 36, and the subsequent pivoting of the elongate element 10 between its horizontal configuration and its vertical configuration.

Figure 9:
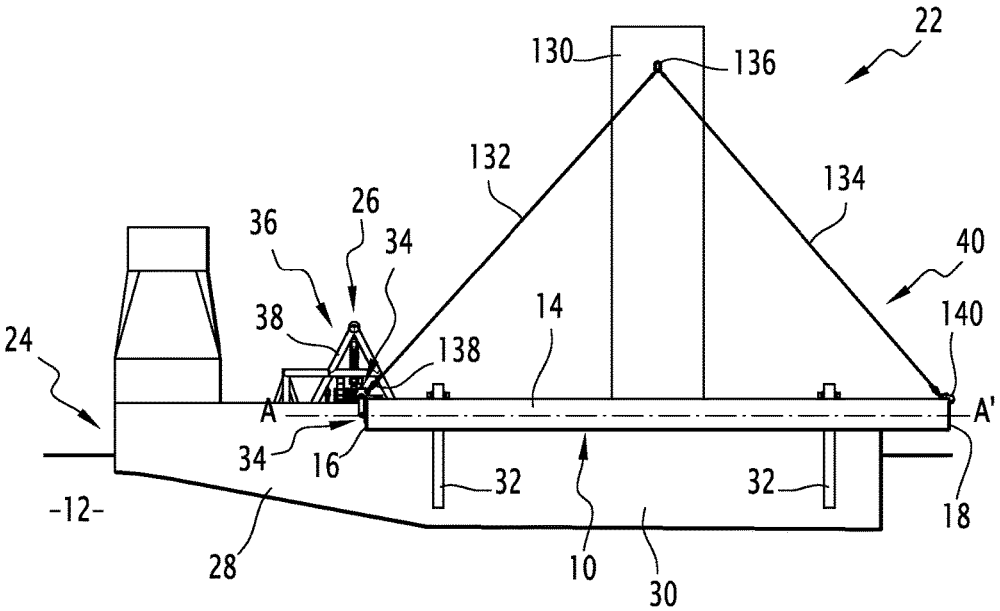
Figure 10:
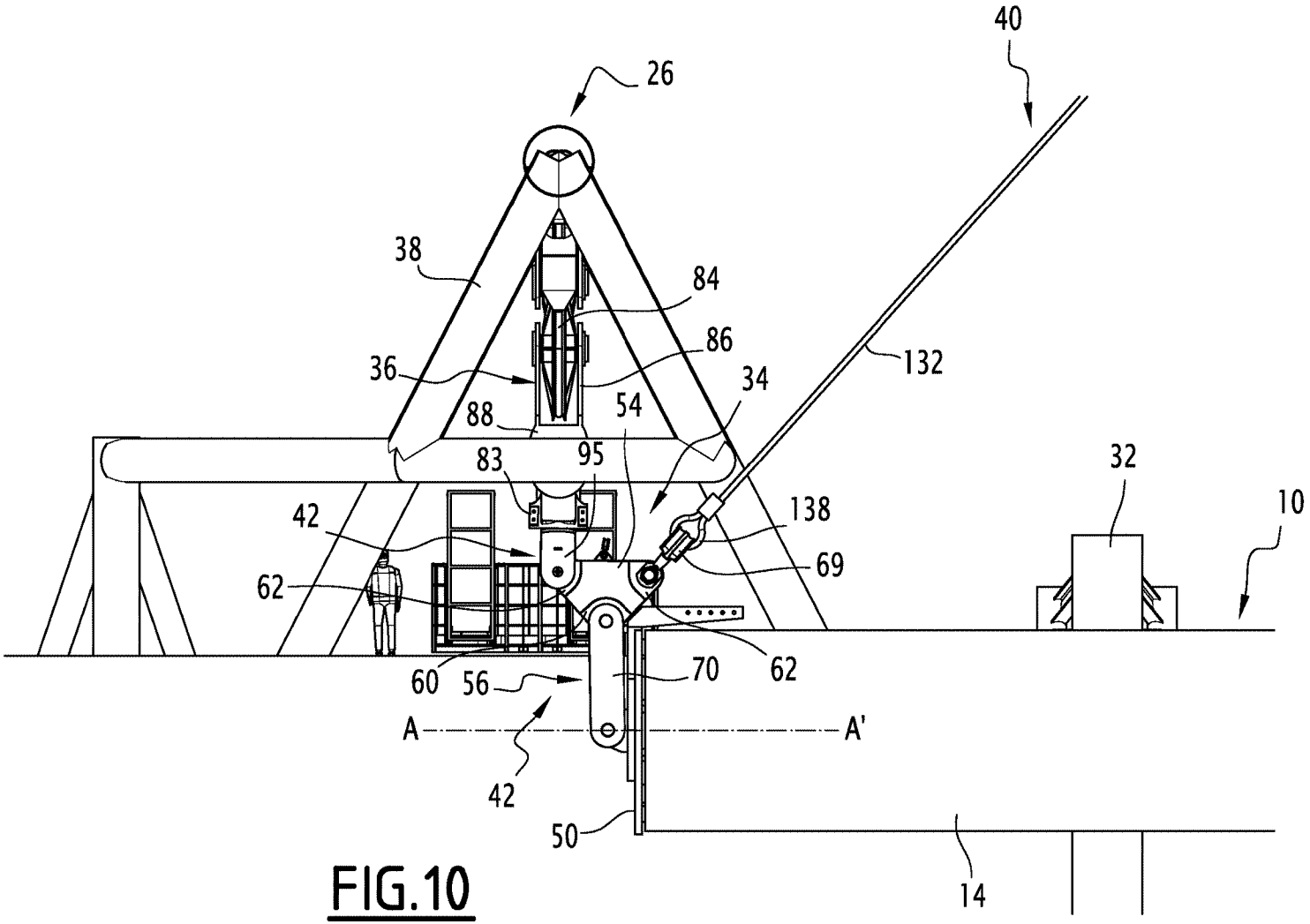
Figure 11:
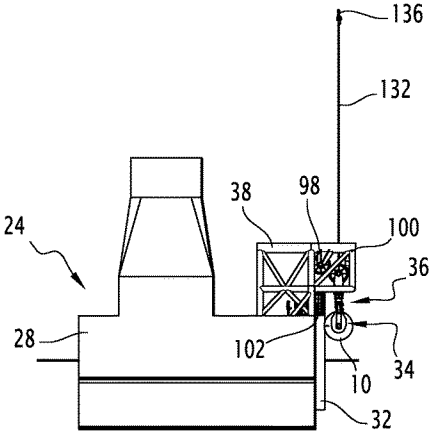

As shown in FIG. 8 and FIG. 9, the movement assembly 40 comprises a crane 130, a first movement line 132, and a second movement line 134. The movement lines 132, 134 are connected together and to the crane 130 by a connecting ring 136.

Alternatively, the lines 132, 134 are separated from one another and are operated independently by the crane 130.

At its distal end 138, the first line 132 advantageously comprises a fast connection/disconnection member 69, capable of being reversibly engaged in the hole 68 of the connecting member 34. The member 69 is, for example, in the form of a shackle.

The second line 134 advantageously includes an end hook 140 at its distal end and intended to hook in the second end 18 of the elongate element 10.

The crane 130 can be activated to move the first line 132 and second line 134 together along the shell surface 30 in order to position the elongate element 10 along this surface 30 and to move it during translation along the axis B-B'.

The crane 130 is further able to manoeuvre the first line 132 and the second line 134 in order to raise or lower the elongate element 10 into its horizontal configuration. In the example shown in the Figures, the movement of the first line 132 and the second line 134 is joined in order to raise or lower the elongate element 10.

The lowering assembly 44 is partially shown in FIG. 3. It includes a winch 150 and a lowering line 152 that can be deployed with respect to the winch 150.

In this example, the distal end of line 152 is attached to the frame 38 at the link 100.

Line 152 is wound under the connecting pulley 84 of the retaining member 36 between the attachment link 100 and the pulley 98.

Line 152 is further wound over the pulley 98 between the winch 150 and the connecting pulley 84.

The deployment of the line 152 causes it to be unwound between the pulley 98 and the link 100, and consequently lower the retaining member 36, and possibly the connection member 34 when it is engaged with the retaining member 36.

The lowering assembly 44 thus forms a two strand hoist.

The operation of the installation 22 according to the invention, during the installation of an elongate element 10 in the stretch of water 12 will now be described.

Initially, the elongate element 10 is brought into the vicinity of the lateral surface 30 of the shell of the surface facility 24 by being transported, for example, on a barge (not shown).

The connecting member 34 is then positioned at the first end 16 of the elongate element 10.

For this purpose, the head 50 is inserted into the receiving recess 20. The locking mechanism 52 is activated to deploy the jaws 53. The attachment of the connecting member 34 is completely reversible. It does not involve drilling the tubular wall 14 of the elongate element 10.

The movement assembly 40 is then connected to the elongate element 10 and the connecting member 34.

To do this, the first line 132 is engaged with the connecting member 34 attached to the first end 14 of the elongate element 10.

The connection/disconnection member 69 of the first line 132 is thus inserted into the mounting hole 68 formed in the second region 62 of the articulation element 54, as shown in FIG. 4.

The second line 134 is engaged on the second end 18 of the elongate element 10.

For this purpose, the hook end 140 is inserted into the tubular wall 14 at the second end 18.

The crane 130 is then activated to lift the elongate element 10 away from the barge in order to move it along the lateral surface 30 to approach the first end 16 of the frame 38.

The lowering assembly 44 is then configured to hold the retaining member 36 in the frame 38. The length of the lowering line 152 deployed out of winch 150 is minimal.

The upper part 80 of the retaining member 36 is wedged between the lateral flanges 103 in the passage 104 in order to block it in translation along the axis B-B'.

The lower part 84 remains free to rotate about the axis CC' and about the axis D-D' in order to allow easy introduction of the pivots 110 carried by the connecting member 34 in the grooves 112 formed in the lower part 84 of the retaining member 36.

As illustrated in FIG. 3, the upper pulley 84 of the retaining member 36 is arranged between the pulley 98 and the attachment link 100, with its axis substantially parallel to the axis B-B' of the surface facility 24.

In this configuration, the lower part 82 of the retaining member 36 protrudes under the frame 38 in the vicinity of the platform 102, when the latter is present.

The elongate member 10 extends along the lateral surface 30, substantially parallel to the axis B-B'.

The movement assembly 40 is then operated to bring the connecting member 34 into the vicinity of the retaining member 36.

The third region 64 of the articulation element 54 is inserted into the hook 95 of the retaining member 36, preferably in the slot 95A.

This insertion is, for example, accompanied by an operator on the platform 102. It is facilitated by the availability of several degrees of rotational freedom between the upper part 80 and the lower part 82 of the retaining member 36 to form a universal joint.

During this insertion, each pivot 110 enters a groove 112 at a first axial end and descends into the groove 112 as far as the second axial end.

Once each pivot 110 is in position, the locking assembly 114 is activated by deploying each outer pin 118 in a corresponding locking hole 119, formed in the hook 95, and then by deploying the inner locking pin 120.

Then the connecting member 34 engaged in the retaining member 36 in its lowering position. It is held in position by the locking assembly 114, without the locking unit 114 taking up the load.

The pivot mechanism 42 is active, with each pin 110 being received in a corresponding groove 112.

The installation 22 is then in the position shown in FIG. 9.

In this position, the elongate element 10 occupies its horizontal configuration. The first end 14 is located under the frame 38.

The connecting member 34 is suspended from and under the retaining member 36. The retaining member 36 is suspended from the frame 38 via the lowering line 152.

Then, the elongate element 10 is pivoted from its substantially horizontal configuration into its substantially vertical configuration.

Figure 12:
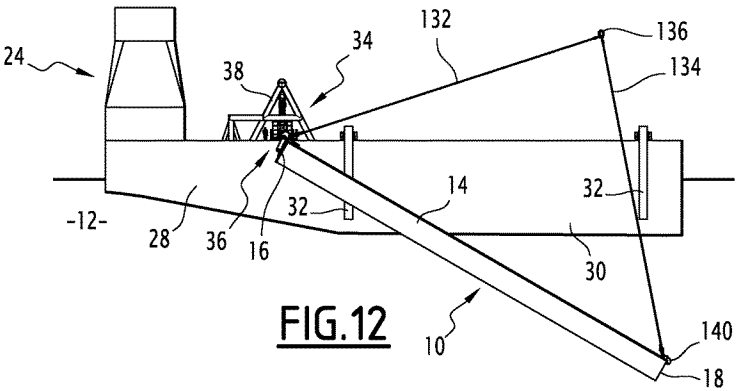

As shown in FIG. 12, the crane 130 lowers the second line 134 and the second end 18 of the elongate element 10 under the stretch of water 12, and under the first end 16. This is done in the embodiment shown by lowering the ring 136.

During this lowering, the second line 134 remains stretched and takes up a part of the weight of the elongate element 10.

During this movement, the retaining member 36 remains substantially vertically stationary. It maintains the connecting member 34 and the first end 16 of the elongate element 10 at a substantially constant height.

The elongate element 10 pivots about a horizontal axis located in the vicinity of the first end 16. To do this, the pivots 110 begin to rotate in each groove 112. The connecting member 56 also allows this pivoting via its articulation points, firstly on the head 50, and secondly, on the first region 60 of the articulation element 64.

When the elongate element 10 reaches its substantially vertical configuration, shown in FIG. 13, the first line 132 is relaxed.

The weight of the elongate element 10 is then taken up by the connecting member 34, by the retaining member 36, and by the lowering line 152.

The elongate element 10 is then located under the frame 38 by being suspended from the retaining member 36 via the connecting member 34. The connecting member 56 projects vertically downwards from the articulation element 54, between the head 50 and the articulation element 54.

The movement assembly 40 is completely disconnected from the elongate element 10 and the connecting member 34, by detaching the fast connection/disconnection member 69 and releasing the hook 140 by gravity.

Thereafter, the winch 150 is activated to deploy the lowering line 152. This deployment causes the joint lowering of the retaining member 36, the connecting member 34 suspended from the retaining member 36, and the elongate element 10 suspended from the connecting member 34.

When the elongate element 10 is an anchor pile, it is lowered to the bottom of the stretch of water 12. It is then inserted into the bottom of the stretch of water 12.

Then, the locking mechanism 52 of the connecting member 34 is released. The head 50 is extracted from the receiving housing 20. The connecting member 34 detaches from the first end 16 of the elongate element 10.

The connecting member 34 is then raised to the surface while suspended from the retaining member 36, via the lowering line 152, as shown in FIG. 15.

It can then be disconnected from the retaining member 36 in order to be reversibly mounted on another elongate element 10.

The installation device 26 and the associated method are therefore particularly easy to use. The implementation of the device 26 and the associated method requires a simple reversible attachment of a connecting member 34 at a first end 16 of the elongate element 10 in a horizontal configuration of the elongate element 10, and then the reversible connection of the connecting member 34 with the retaining member 36 to allow pivoting of the elongate element 10 to its vertical configuration.

In particular, no drilling has to be made in the wall 14 of the elongate element 10, which avoids weakening it and increases its life, while limiting the operations to be carried out in the open sea during installation.

What is claimed is:

1. A method for installing an elongate element in a stretch of water, comprising the following steps:

reversibly fastening of a connecting member at a first end of the elongate element;

arranging of the elongate element in a substantially horizontal configuration along a surface facility;

reversibly engaging of the connecting member in a retaining member projecting with respect to the surface facility;

pivoting the elongate element about a substantially horizontal axis to move the elongate element into a substantially vertical configuration, while the connecting member remains engaged in the retaining member, wherein the substantially horizontal axis for pivoting the elongate element is located in a vicinity of the first end of the elongate element selected for enabling the pivoting of the elongate element into the substantially vertical configuration;

jointly lowering of the retaining member, the connecting member and the elongate element in the stretch of water with a lowering line carried by the surface facility;

detaching of the connecting member of the first end of the elongate element, and jointly raising of the retaining member and the connecting member; and suspending the retaining member from a support frame via the lowering line, whereby the support frame for the retaining member is fixed to the surface facility and projects with respect to the stretch of water.

2. The method according to claim 1, wherein the reversible engagement of the connecting member in the retaining member comprises the suspension of the connecting member and the first end of the elongate element under the retaining member.

3. The method according to claim 1, wherein the reversible engagement of the connecting member in the retaining member comprises the releasable locking of the connecting member in the retaining member.

4. The method according to claim 1, comprising engaging a first movement line on the connecting member and engaging a second movement line at a second end of the elongate element, wherein the elongate element is suspended between the first movement line and the second movement line, wherein the arrangement of the elongate element in its substantially horizontal configuration along the surface facility is performed by maneuvering the first movement line and/or the second movement line.

5. The method according to claim 1, wherein the reversible attachment of the connecting member comprises the insertion of a connecting head of the connecting member in an end housing located at the first end of the elongate element and the reversible locking of the connecting head on the first end of the elongate element without drilling of the elongate element upon insertion and locking.

6. The method according to claim 5, wherein the connecting member includes an articulation element, the connecting head being pivotally connected to a first region of the articulation element, and the method comprising engaging a first movement line of the elongate element on a second region of the articulation element, and the reversible engagement of a third region of the articulation element on the retaining member.

7. A device for introduction of an elongate element in a stretch of water, comprising:

a connecting member adapted to be reversibly attached to a first end of the elongate element;

an assembly for moving the elongate element into a substantially horizontal configuration along a surface facility;

a retaining member intended to project with respect to the surface facility, the connecting member being reversibly movable between a starting position in which it is disengaged from the retaining member and a lowering position in which it is engaged in a reversible manner in the retaining member;

a mechanism to pivot the elongate element about a substantially horizontal axis in order to move the elongate element into a substantially vertical configuration, wherein the connecting member remains engaged in the retaining member, wherein the substantially horizontal axis for pivoting the elongate element is located in a vicinity of the first end of the elongate element selected for enabling the pivoting of the elongate element into the substantially vertical configuration; and an assembly comprising the retaining member, the connecting member and the elongate element for joint lowering into the stretch of water having a lowering line carried by the surface facility, wherein the retaining member is suspended from a support frame via the lowering line by which the support frame for the retaining member is fixed to the surface facility and projects with respect to the stretch of water.

8. The device according to claim 7, wherein in the lowering position, the connecting member is suspended from the retaining member.

9. The device according to claim 7, wherein the connecting member includes a reversible locking assembly in the retaining member.

10. The device according to claim 7, wherein the movement assembly includes a first movement line to be engaged on the connecting member and a second movement line to be engaged at a second end of the elongate element in order to suspend the elongate element between the first movement line and the second movement line, wherein the movement assembly comprises a maneuvering device for the first movement line and/or the second movement line.

11. The device according to claim 7, wherein the connecting member comprises an insertion head for insertion without drilling in a housing provided at the first end of the elongate element, and a reversible locking mechanism able to operate without drilling of the insertion head in the housing.

12. The device according to claim 11, wherein the connecting member includes an articulated element, the connecting head being pivotally connected to a first region of the articulation element, the articulation element having a second region intended to be engaged by a first movement line of the moving assembly, and a third region of the articulation element for engaging with the retaining member.

13. The device according to claim 7, wherein the retaining member comprises an upper part intended to be carried by the lowering line and a lower engagement hook of the connecting member.

14. The device according to claim 13, wherein the upper part and the lower hook are rotatable with respect to one another along at least three axes.

15. The device according to claim 7, comprising a frame intended to project with respect to the surface facility.

16. The device according to claim 15, wherein the retaining member is suspended under the frame.

17. An installation for introduction of an elongate element in a stretch of water, comprising:

a device according to claim 7, carried by the surface facility.

18. The installation according to claim 17, wherein the surface facility floats on the stretch of water.

19. A method for installing an elongate element in a stretch of water, comprising the following steps:

reversibly fastening of a connecting member at a first end of the elongate element;

engaging a first movement line on the connecting member and engaging of a second movement line at a second end of the elongate element, the elongate element being suspended between the first movement line and the second movement line;

maneuvering the first movement line and/or the second movement line to arrange the elongate element in a substantially horizontal configuration along the surface facility;

reversibly engaging of the connecting member in a retaining member projecting with respect to the surface facility;

pivoting the elongate element into a substantially vertical configuration by lowering the second movement line and the second end of the elongate element with a crane under the stretch of water and under the first end of the elongate element, the second movement line remaining stretched and taking up a part of the weight of the elongate element, the retaining member remaining substantially vertically stationary during the lowering;

jointly lowering of the retaining member, the connecting member and the elongate element in the stretch of water with a lowering line carried by the surface facility;

detaching of the connecting member of the first end of the elongate element, and jointly raising of the retaining member and the connecting member;

suspending the retaining member from a support frame via the lowering line, whereby the support frame for the retaining member is fixed to the surface facility and projects with respect to the stretch of water.

* * * * *